US008749164B2

(12) United States Patent
Chung et al.

(10) Patent No.: US 8,749,164 B2
(45) Date of Patent: Jun. 10, 2014

(54) ILLUMINATING APPARATUS CAPABLE OF DETECTING POWER SUPPLY AND METHOD USING THE SAME

(75) Inventors: Chia-Tin Chung, Miaoli County (TW); Shih-Neng Tai, Taoyuan County (TW)

(73) Assignee: Paragon Semiconductor Lighting Technology Co., Ltd., New Taipei (TW)

( * ) Notice: Subject to any disclaimer, the term of this patent is extended or adjusted under 35 U.S.C. 154(b) by 320 days.

(21) Appl. No.: 13/242,735

(22) Filed: Sep. 23, 2011

(65) Prior Publication Data

US 2013/0076247 A1 Mar. 28, 2013

(51) Int. Cl.
*G05F 1/00* (2006.01)

(52) U.S. Cl.
USPC ..... 315/291; 315/247; 315/185 S; 315/312; 315/276

(58) Field of Classification Search
USPC ..... 315/291, 307–326, 276–279, 185 S, 315/224, 225, 247, 200 R
See application file for complete search history.

(56) References Cited

U.S. PATENT DOCUMENTS 8,436,550 B2 * 5/2013 Maehara ..... 315/291
2009/0184663 A1 * 7/2009 Reinle ..... 315/294

* cited by examiner

*Primary Examiner* — Tuyet Thi Vo
(74) *Attorney, Agent, or Firm* — Rosenberg, Klein & Lee

(57) ABSTRACT

An illuminating apparatus is disclosed. The illuminating apparatus includes a detecting unit, an illuminating unit, and a control unit. The illuminating unit includes multiple illuminating sets and a switching unit for adjusting a connection relationship among the illuminating sets. The detecting unit is for detecting an inputted power supply received by the illuminating unit while the control unit is coupled to the detecting unit and the switching unit. The control unit based on a detected inputted power supply controls the switching unit according to a predetermined setting parameter, so as to ensure a conducting voltage of the illuminating unit to vary according to a variation in the inputted power supply.

12 Claims, 6 Drawing Sheets

ILLUMINATING APPARATUS CAPABLE OF DETECTING POWER SUPPLY AND METHOD USING THE SAME

BACKGROUND OF THE INVENTION

1. Field of the Invention

The present invention relates to an illuminating apparatus and a method using the same, and more particularly, to an illuminating apparatus equipped with light emitting diodes (LED) and capable of detecting an inputted power supply and a method using the same.

2. Description of Related Art

As technology progresses, light emitting diodes (LED) have been gaining their momentum as an alternative means for lighting as they are generally associated with lower power consumption, higher brightness, and extended shelf time. Please refer to FIG. 1 as a schematic diagram of an illuminating apparatus. The illuminating apparatus includes a rectifying circuit 90, an illuminating set 92 having multiple LED connected in series, and a current source 94. The rectifying circuit 90 could be a full-wave rectifying circuit receiving an alternating current before generating pulsed direct current as an inputted power supply for the illuminating set 82. The current source 94 is for providing a stable current with the LEDs in the illuminating set 92. And when more serially connected LEDs are conducted, the current source 94 is required to provide the current of a larger value as the result of an increase in a conducting voltage for the illuminating set 92.

When the conducting voltage for the illuminating set 92 increases, the pulsed DC-based inputted power supply needs to be larger than the conducting voltage for the illuminating set 92 to be conducted. In other words, the increased conducting voltage for the illuminating set 92 corresponds to a shorter conducting time for the same, resulting in more occurrences of flicks.

SUMMARY OF THE INVENTION

The primary objective of the present invention is to provide an illuminating apparatus to minimize the occurrence of the flicks.

The disclosed illuminating apparatus includes an illuminating unit, a detecting unit, and a control unit. The illuminating unit includes multiple illuminating sets and a switching unit for adjusting a connection relationship among the illuminating sets. The detecting unit is for detecting the inputted power supply with the control unit coupled between the detecting unit and the switching unit for controlling a conducting voltage of the illuminating unit to vary according to a variation in the inputted power supply based on the detected inputted power supply that corresponds to a predetermined setting parameter.

One embodiment of the present invention further includes the illuminating unit having a first light emitting diode (LED) module, a second LED module, and a second switching circuit. The first LED module includes a first illuminating set, a second illuminating set, and a first switching circuit for controlling a connection relationship between the first illuminating set and the second illuminating set. Meanwhile, the second LED module includes a third illuminating set and a fourth illuminating set and a third switching circuit for controlling a connection relationship between the third illuminating set and the fourth illuminating set.

The control unit, which is coupled to the first switching circuit, the second switching circuit, and the third switching circuit, is for controlling operations of the first switching circuit, the second switching circuit, and the third switching circuit, based on the detecting unit detecting the inputted power supply with the detected inputted power supply corresponding to the predetermined setting parameter. As such, the conducting voltages of the first illuminating set, the second illuminating set, and the third illuminating set may vary according to the variation in the inputted power supply.

An illuminating method using the illuminating apparatus according to the present invention includes preparing the setting parameter corresponding to the inputted power supply, and controlling the connection relationship among the illuminating sets in the illuminating unit based on the detected inputted power supply by controlling the switching unit, for ensuring the conducting voltages of the illuminating sets to vary according to the variation in the inputted power supply.

To sum up, the illuminating apparatus may adjust the conducting voltage of the illuminating unit (or the illuminating set) thereof for extending the conducting time of the illuminating unit in a period of the inputted power supply, effectively reducing the occurrence of the flicks.

In order to further the understanding regarding the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

The present invention relates to an illuminating apparatus and a method using the same. The disclosed illuminating apparatus includes an illuminating array having multiple light emitting diodes (LED). The illuminating apparatus according to the present invention may detect a power supply received by the illuminating array and prepare a setting parameter for adjusting connection relationship among the LEDs. Consequently, a conducting voltage for the illuminating array may become adjustable, allowing for the illuminating apparatus with the illuminating array to utilize more than one power supply.

The conducting voltage of the illuminating array may become larger when the LEDs are connected in series and may be lowered when the LEDs are connected in parallel. Also, part of the LEDs may be connected in series while the rest of the LEDs are connected in parallel for adjusting the conducting voltage of the illuminating array, enhancing illuminating efficiency of the illuminating apparatus and minimizing occurrences of flicks.

Figure 1:
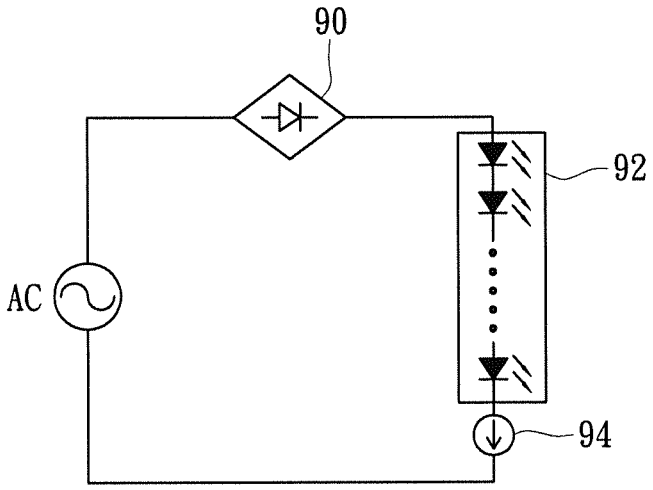
FIG. 1 PRIOR ART
FIG. 1 shows a schematic diagram of an illuminating apparatus.
Figure 2:
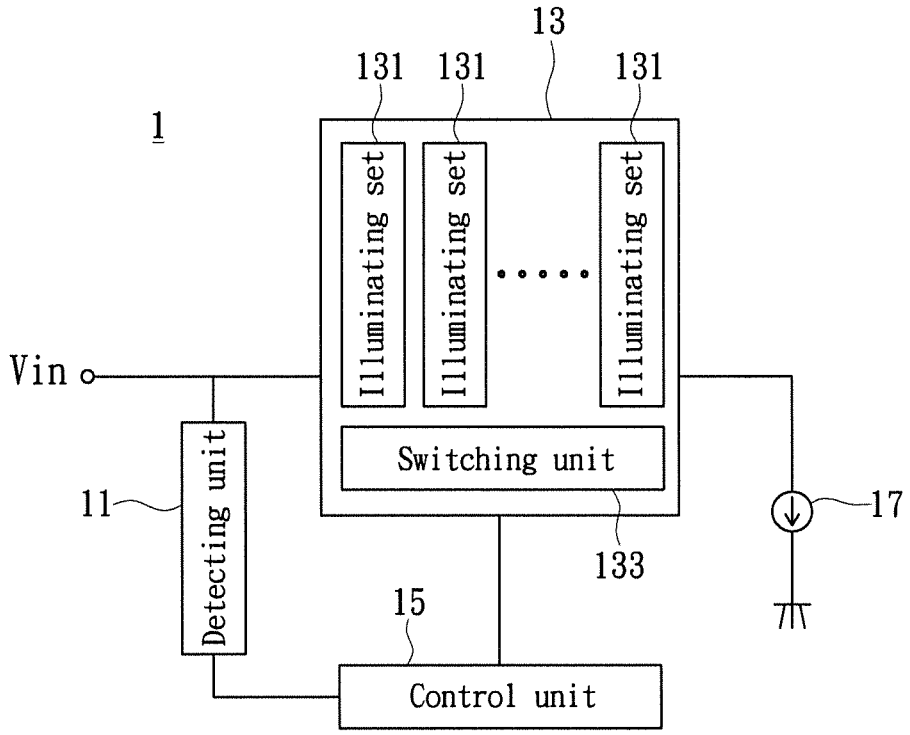
FIG. 2 shows a simplified block diagram of an illuminating apparatus according to another embodiment of the present invention.

Referring to FIG. 2 in which a simplified block diagram of an illuminating apparatus 1 according to an embodiment of the present invention is illustrated. The illuminating apparatus 1 includes a detecting unit 11, an illumination unit 13, and a control unit 15 coupled between the detecting unit 11 and the illumination unit 13.

The detecting unit 11 may be configured to detect an inputted power supply ($V_{in}$) for the illumination unit 13. For example, the detecting unit 11 may detect specification of the inputted power supply ($V_{in}$) including a peak value of an inputted voltage and phase variation. In order to detect the specification of the inputted power supply, the detecting unit 11 may include a phase detecting circuit and/or a voltage detecting circuit (DC). The inputted power supply in the following description may be of a pulsed direct current in the form of full waves or half waves that is an end product of a rectified alternating current. It is worth noting that an inputted power supply of full-wave pulsed DC is applied in embodiments illustrated in subsequent paragraphs.

The illumination unit 13 may include a plurality of illumination sets 131 and a switching unit 133. In one implementation, the illumination set 131 includes multiple LEDs connected in series. And the illumination set 131 may be conducted when receiving the inputted power supply, while the switching unit 133 may be configured to adjust connection relationships among the illumination sets 131. In one implementation, the switching unit 133 may include multiple switching components.

When it comes to adjusting the connection relationship among the illumination sets 131 by the switching unit 133, the switching unit 133 may cause one illumination set 131 to be in a serial connection with one or more other illumination sets 131. Similarly, the switching unit 133 may be configured to cause one illumination set 131 to be connected with one or more other illumination sets 131 in parallel. It is worth noting that more than one illumination set 131 may be grouped together with groups of the illumination sets 131 in operation. And one group of the illumination sets 131 may be in a serial/parallel connection with other groups of the illumination sets 131.

The control unit 15 controls the switching unit 133 on basis of the detecting unit 11 detecting the inputted power supply. By controlling the switching unit 133, the control unit 15 may cause the connection relationship among the illumination sets 131 to be adjusted depending on the varying inputted power supply, for ensuring the illumination unit 13 to be operating properly. Specifically speaking, when the control unit 15 detects the peak value of the inputted power supply through the detecting unit 11 the control unit 15 may determine the setting parameter according to the detected peak value of the inputted power supply. When the peak value of the inputted power supply varies, the control unit 15 may further re-configure the setting parameter accordingly in order to control the switching unit 133, which in turn may adjust the conducting voltage of the illumination unit 13 in response to variation in the inputted power supply.

For example, assume a voltage level of the inputted power supply is larger than the conducting voltage of one illumination set 131 or the conducting voltage of multiple illumination sets 131 in the serial connection the control unit 15 may control the switching unit 13 to alter the connection relationship among the illumination sets 131 to ensure conduction of the illumination sets 131. In one implementation, the control unit 15 may have one or more predetermined threshold voltages incorporated serving as the basis on which the switching unit 133 may be controlled. In another implementation, the switching unit 133 may be controlled based on one more predetermined time periods.

The illuminating apparatus 1 may further include a current source 17 coupled to the illuminating unit 13. And the current source 17 may provide a stable current when the illuminating sets 131 are conducted. In another implementation, the current source 17 may be a controllable current source that is controlled by the control unit 15. The controllable current source 17 may thus serve as a source capable of providing different currents with the illuminating sets 131 with the provided currents depending on different connection relationships among the illuminating sets 131. For example, when the conducing voltage for the illuminating unit 13 is lowered as the result of an increased number of the illuminating sets 131 connected in parallel a larger conducting current may become necessary requiring the current source 17 to provide the same. On the other hand, the larger conducting voltage may correspond to an increased number of the illuminating sets 131 connected in series, requiring the current source 17 to provide a smaller conducting current with the illuminating unit 13.

Figure 3:
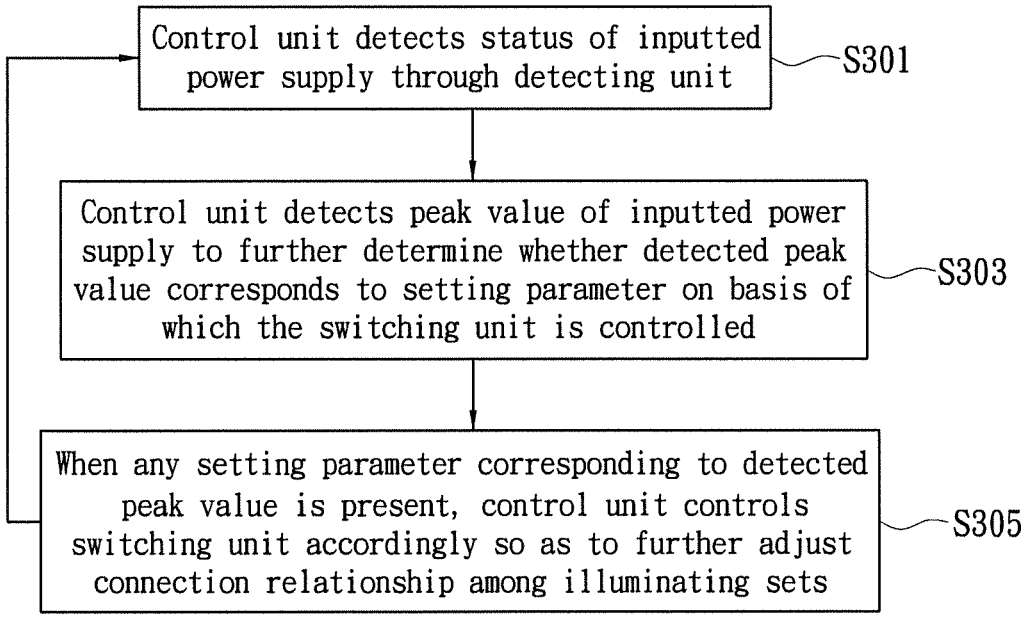
FIG. 3 illustrates a flow chart of an illuminating method using the illuminating apparatus according to one embodiment of the present invention.

In conjunction with FIG. 2, FIG. 3 illustrates a flow chart of an illuminating method using the illuminating apparatus according to one embodiment of the present invention.

The illuminating method shown in FIG. 3 may include following steps. In step 301, the control unit 15 detects a status (or the specification) of the inputted power supply through the detecting unit 11. In step 303, the control unit 15 may detect the peak value of the inputted power supply in order to further determine whether the detected peak value may correspond to the setting parameter on basis of which the switching unit 133 may be controlled. When any setting parameter corresponding to the detected peak value is present, the control unit 15 may control the switching unit 133 accordingly so as to further adjust the connection relationships among the illuminating sets 131 (step 305). It is worth noting that the setting parameter may be representative of the inputted power supply sufficient to conduct the switching unit 133.

Figure 4:
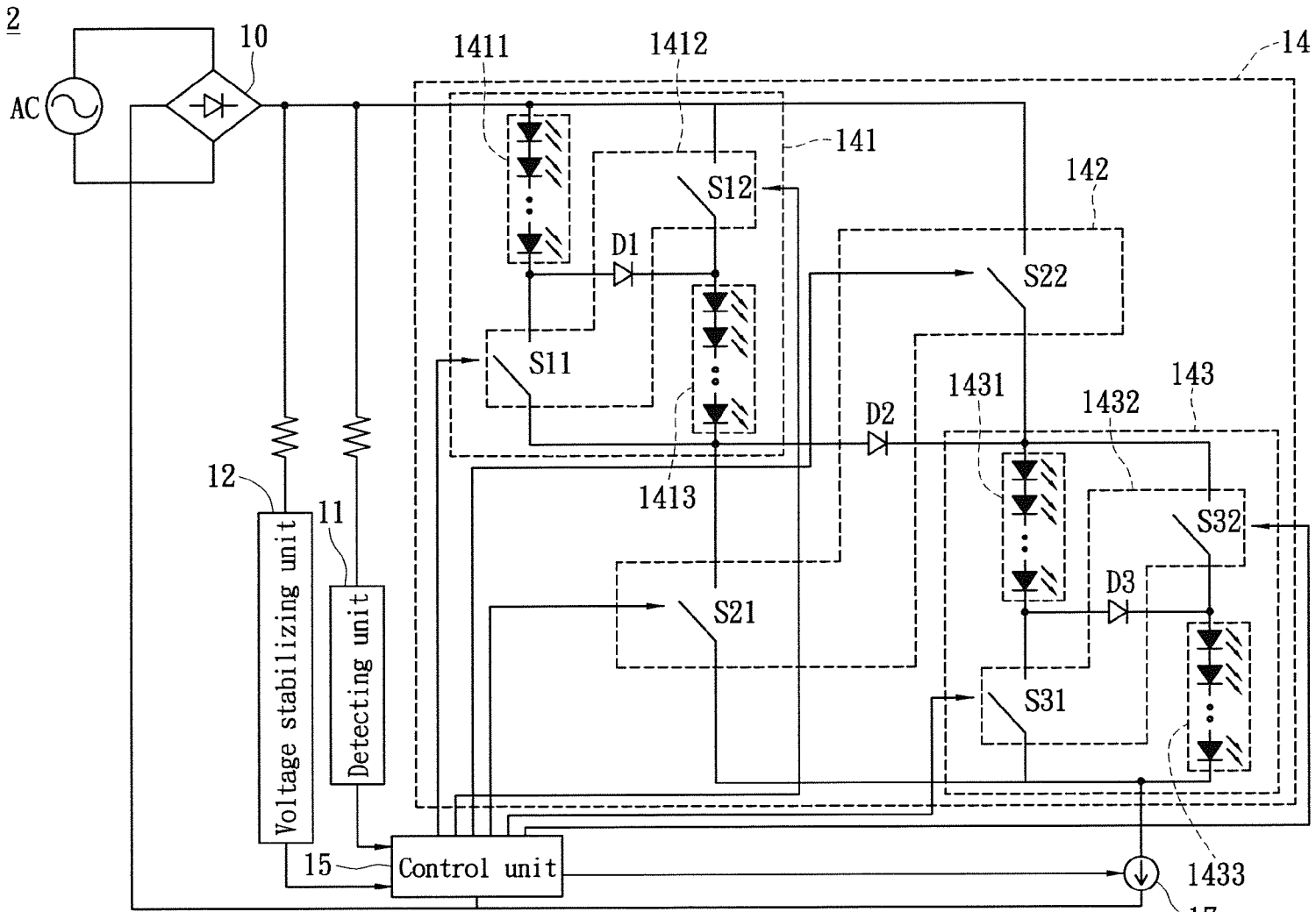
FIG. 4 is a simplified block diagram illustrating an illuminating apparatus having an inputted power supply incorporated according to one embodiment of the present invention.

FIG. 4 is a simplified block diagram illustrating an illuminating apparatus 2 having an inputted power supply incorporated according to one embodiment of the present invention. The illuminating apparatus 2 may include a rectifying unit 10, the detecting unit 11, a voltage stabilizing unit 12, an illuminating unit 14, the control unit 15, and the current source 17. The rectifying unit 10 may be coupled to the detecting unit 11, the voltage stabilizing unit 12, and the illuminating unit 14. The control unit 15, meanwhile, may be coupled to the detecting unit 11, the voltage stabilizing unit 12, and the illuminating unit 14.

In one implementation, the rectifying unit 10 is a full-wave rectifier rectifying waveforms of an alternating current (AC) into the inputted power supply received by the illuminating unit 14. In another implementation, the rectifying unit 10 is a half-wave rectifier.

The voltage stabilizing unit 12 may stabilize the inputted power supply in order to output a DC voltage source at a fixed voltage level for use of the control unit 15.

The illuminating unit 14 includes a plurality of LED modules including a first LED module 141 and a second LED module 143. It is worth noting that the connection relationship between the first LED module 141 and the second LED module 143 (e.g., the first LED module 141 and the second OLED module 143 are connected in series) may be facilitated by a second switching circuit 142. The LED modules each may include multiple illuminating sets and a switching unit. For example, the first LED module 141 may include a first illuminating set 1411 and a second illuminating set 1413 when both the first illuminating set 1411 and the second illuminating set 1413 may be equal in their respective numbers of the LEDs connected in series. And each illuminating set may receive the inputted power supply and in a conducting state when the received inputted power supply exceeds the conducting voltage of the illuminating set.

The switching unit for the first LED module 141 may be a first switching circuit 1412 including a first switching component S11, a second switching component S12, and a first unilaterally conducted component D1. The first switching component S11 is coupled to a first end of the first illuminating set 1411, the second switching component S12 is coupled to a first end of the second illuminating set 1413, and the first unilaterally conducted component D1 is coupled between the first illuminating set 1411 and the second illuminating set 1413. In one implementation, the first switching component S11 and the second switching component S12 may be mechanical switches or electronic switches. When the first switching component S11 and the second switching component S12 are the electronic switches, they may be implemented by Darlinton circuitry. The first unilaterally conducted component D1 may be a diode.

When the first switching component S11 and the second switching component S12 are not conducted (or not turned on), the first illuminating set 1411, the first unilaterally conducted component D1 and the second illuminating set 1412 are sequentially connected in series and could be conducted (turned on). Additionally, when the first switching component S11 and the second switching component S12 are conducted/turned on the first illuminating set 1411 and the second illuminating set 1412 are connected in parallel with the first unilaterally conducted component D1 not conducted.

The second LED module 143 may include a third illuminating set 1431, a fourth illuminating set 1433, and a third switching circuit 1432 including a third switching component S31, a fourth switching component S32, and a third unilaterally conducted component D3. Since the second LED module 143 may be implemented in the same way as the first LED module 141, operations of the second LED module 143 may be the same as operations of the first LED module 141.

The second switching circuit 142 may include a fifth switching component S21, a sixth switching component S22, and a second unilaterally conducted component D2. The fifth switching component S21 may be coupled between a second end of the first LED module 141 and a second end of the second LED module 143. The sixth switching component S22 may be coupled between the first end of the first LED module 141 and the first end of the second LED module 143. Additionally, the second unilaterally conducted component D2 may be coupled between the second end of the first LED module 141 and the first end of the second LED module 143.

When the fifth switching component S21 and the sixth switching component S22 are not conducted, the first LED module 141, the second unilaterally conducted component D2, and the second LED module 143 may be sequentially connected in series and could be conducted. And when both the fifth component S21 and the sixth switching component S22 are conducted the first LED module 141 and the second LED module 143 may be connected in parallel with the second unilaterally conducted component D2 not conducted.

More specifically, the first LED module 141 and the second LED module 143 may be controllable by the first switching circuit 1412 and the third switching circuit 1432, respectively. Consequently, the connection relationship between the first illuminating set 1411 and the second illuminating set 1413, and the connection relationship between the third illuminating set 1431 and the fourth illuminating set 1433 may be adjusted. And the first LED module 141 and the second LED module 143 may be connected in series or in parallel when the second switching circuit 142 operates. As such, the conducting voltage of the illuminating unit 14 may be adjusted between a maximum conducting voltage and a minimum conducting voltage. It is worth noting that the maximum conducting voltage may correspond to all illuminating sets connected in parallel, while the minimum conducting voltage may correspond to all illuminating sets connected in series.

The control unit 15 based on detecting of the detecting unit 11 may control operations of the first switching circuit 1412, the second switching circuit 142, and the third switching circuit 1432. By conducting the switching components in the first switching circuit 1412, the second switching circuit 142, and the third switching circuit 1432, the control unit 15 may therefore set at least one predetermined conducting voltage between the maximum conducting voltage and the minimum conducting voltage. And the predetermined conducting voltage may correspond to a combination of the switching components in the first switching circuit 1412, the second switching circuit 142, and the third switching circuit 1432 being conducted.

When the control unit 15 is in operation, the control unit 15 may detect the status of the inputted power supply through the detecting unit 11 and determine whether the current inputted power supply may correspond to the predetermined setting parameter. If so, the control unit 15 may further determine according to the setting parameter whether the current inputted power supply may correspond to the predetermined conducting voltage. And when the current inputted power supply corresponds to the predetermined conducting voltage the control unit 15 may further control conductions of the switching components in the first switching circuit 1412, the second switching circuit 142, and the third switching circuit 1432 to adjust the conducting voltage of the illuminating unit 14. Thus, the illuminating unit 14 may operate with the current inputted power supply.

By adjusting the conducting voltage of the illuminating unit 14 the control unit 15 may further adjust the current of the current source 17 supplying the current with the illuminating unit 14.

In conjunction with FIG. 4, FIGS. 5A, 5B, and 5C illustrate flow charts of an illuminating method using an illuminating apparatus according to one embodiment of the present invention. For the illustration purpose, a loading voltage may refer to the conducting voltage of the first illuminating set 1411, the second illuminating set 1413, the third illuminating set 1431, or the fourth illuminating set 1433. And two loading voltages may refer to a sum of two of the conducting voltages of the first illuminating set 1411, the second illuminating set 1413, the third illuminating set 1431, and the fourth illuminating set 1433. Also for the illustration purpose the conducting voltages of the first illuminating set 1411, the second illuminating set 1413, the third illuminating set 1431, and the fourth illuminating set 1433 may be the same.

Figure 5A:
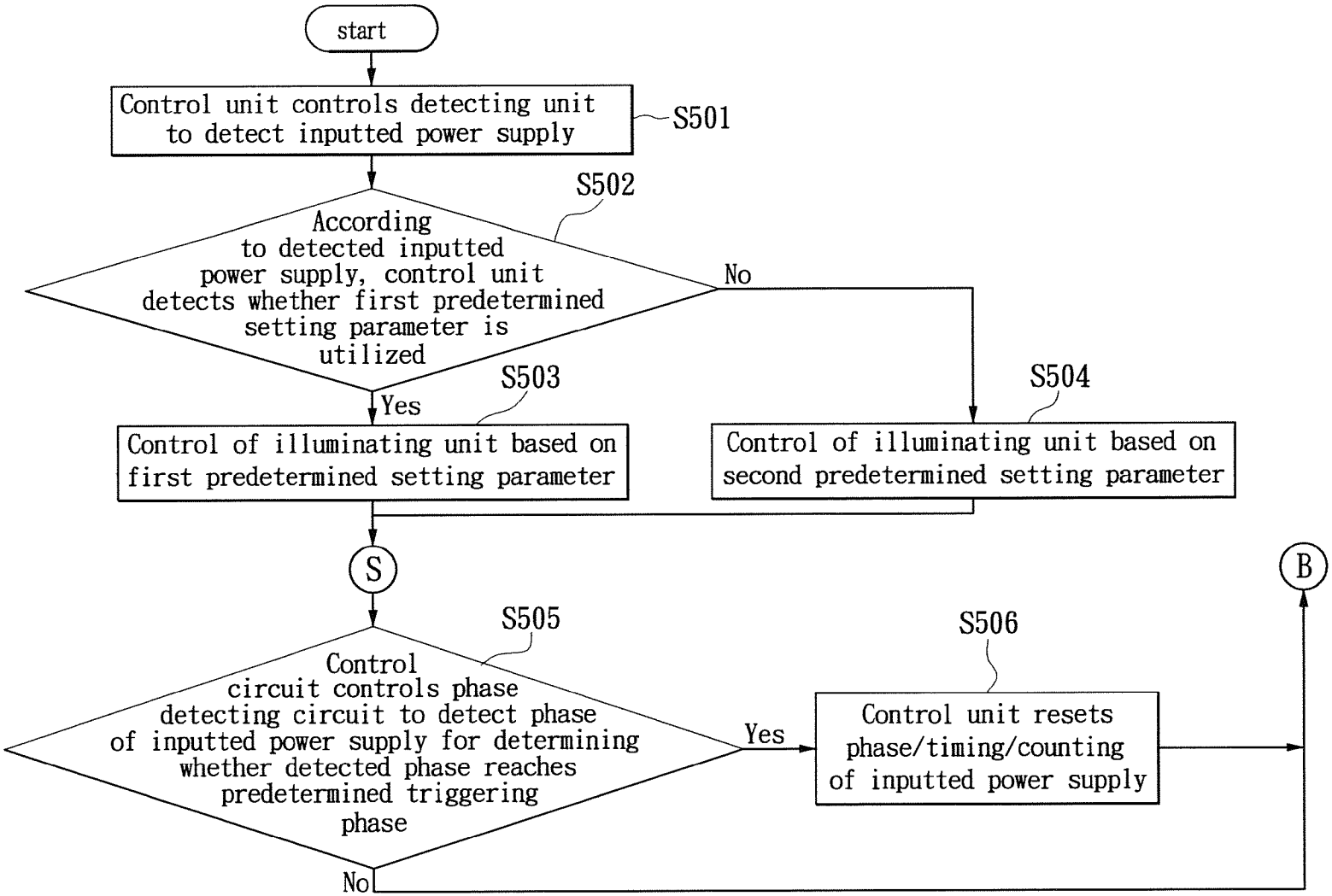
FIG. 5A illustrates a flow chart of an illuminating method using an illuminating apparatus according to one embodiment of the present invention.
Figure 5B:
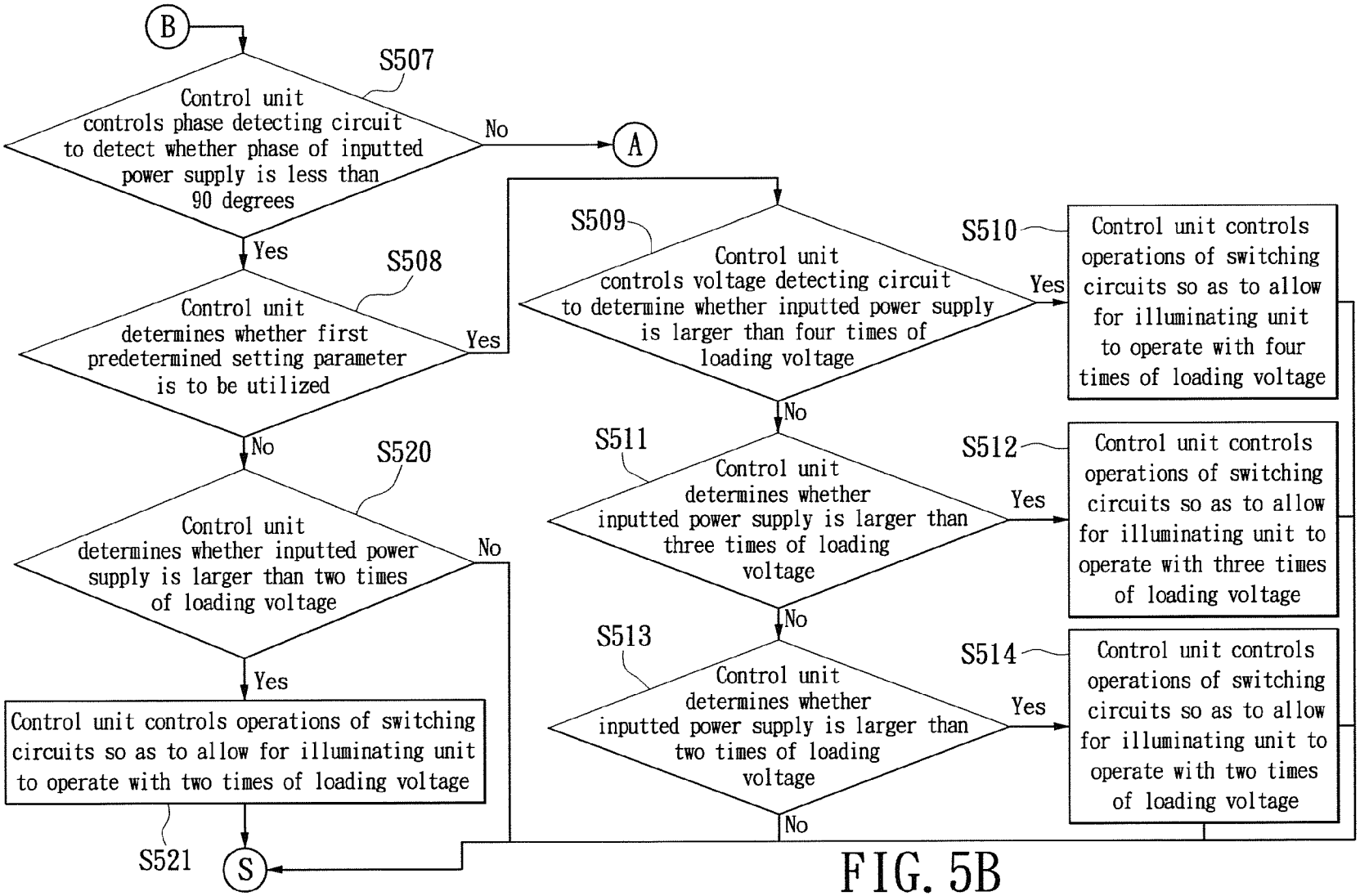
FIG. 5B illustrates a flow chart of an illuminating method using an illuminating apparatus according to one embodiment of the present invention.
Figure 5C:
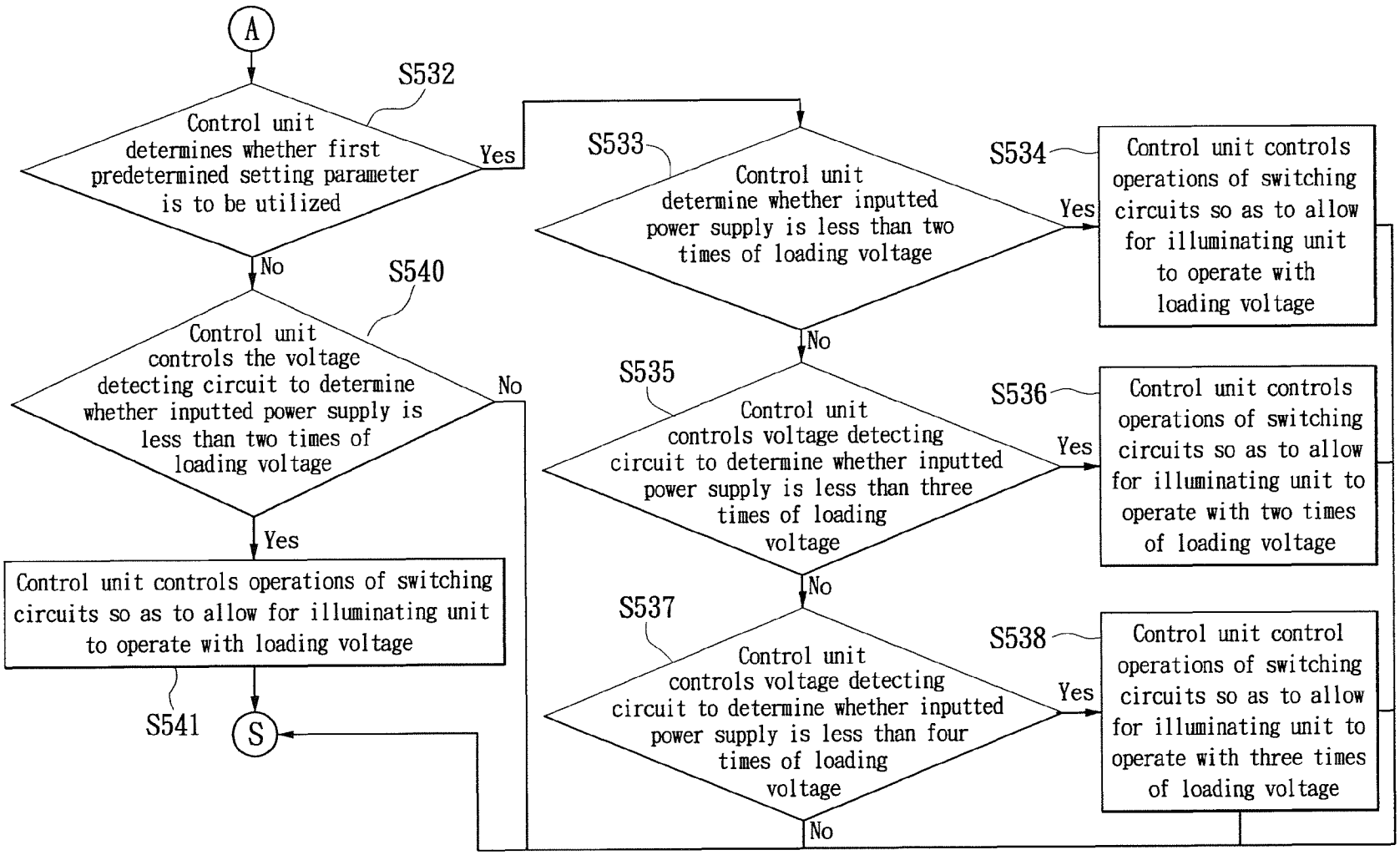
FIG. 5C illustrates a flow chart of an illuminating method using an illuminating apparatus according to one embodiment of the present invention.

FIGS. 5A to 5C include steps in the follows. In step S501, the control unit 15 may control the detecting unit 11 to detect the inputted power supply. In step S502, according to the detected inputted power supply the control unit 15 may detect whether a first predetermined setting parameter may be utilized. If so, control of the illuminating unit 14 may be based on the first predetermined setting parameter (step S503). Otherwise, the control of the illuminating unit 14 may be based on another setting parameter (e.g., a second predetermined setting parameter) (step S504).

The first predetermined setting parameter may be associated with an AC power source ranging between 220 volts to 240 volts. And the second predetermined setting parameter may be associated with another AC power source ranging between 100 volts to 120 volts. It is worth noting that both the first predetermined setting parameter and the second predetermined setting parameter may be associated with different AC power sources of different ranges other than those of 220-240 volts and 100-120 volts.

In step 505, the control circuit 15 may control a phase detecting circuit in the detecting unit 11 to detect the phase of the inputted power supply for determining whether the phase of the inputted power supply has been reaching a predetermined triggering phase. If so, the entire flow may proceed to step S506. Otherwise, the entire flow may proceed to step S507. In one implementation, the predetermined triggering phase is zero phase of the inputted power supply.

In step S506, the control unit 15 may reset the phase/timing/counting of the inputted power supply on which basis the illuminating unit 14 may be controlled thereafter. In step S507, the control unit 15 may control the phase detecting circuit in the detecting circuit 11 to detect whether the phase of the inputted power supply is less than 90 degrees. If so, the flow proceeds to step S508. Otherwise, step S532 may be executed.

In step S508, the control unit 15 may determine whether the first predetermined setting parameter may be utilized. If so, step S509 may be executed. Otherwise, step S520 may be executed.

In step S509, the control unit 15 may control the voltage detecting circuit in the detecting unit 11 to determine whether the inputted power supply is larger than four times of the loading voltage. If so, step S510 may be executed. Otherwise, step S511 may be executed.

In step S510, the control unit 15 may control the operations of the switching circuits so as to allow for the illuminating unit 14 to operate with four times of the loading voltage. For example, the control unit 15 may cause the first illuminating set 1411, the second illuminating set 1413, the third illuminating set 1431, and the fourth illuminating set 1433 to be connected in series and conducted by controlling the first switching component S11, the second switching component S12, the third switching component S31, the fourth switching component S32, the fifth switching component S21, and the sixth switching component S22 not to be conducted.

In step S511, the control unit 15 may determine whether the inputted power supply is larger than three times of the loading voltage through the voltage detecting circuit in the detecting unit 11. If so, step S512 may be executed. Otherwise, step S513 may be executed.

In step S512, the control unit 15 may control the operations of the switching circuits so as to allow for the illuminating unit 14 to operate with three times of the loading voltage. For example, the control unit 15 may cause the first illuminating set 1411 and the second illuminating set 1413 to be connected in series and conducted, the third illuminating set 1431 and the fourth illuminating set 1433 to be connected in parallel and conducted, and the first LED module 141 and the second LED module 143 to be connected in series, by controlling the first switching component S11, the second switching component S12, the fifth switching component S21, and the sixth switching component S22 not to be conducted, and the third switching component S31 and the fourth switching component S32 to be conducted.

In step S513, the control unit 15 may determine whether the inputted power supply is larger than two times of the loading voltage through the voltage detecting circuit in the detecting unit 11. If so, step S514 may be executed. Otherwise, step S505 may be returned.

In step S514, the control unit 15 may control the operations of the switching circuits so as to allow for the illuminating unit 14 to operate with two times of the loading voltage. For example, the control unit 15 may cause the first illuminating set 1411 and the second illuminating set 1413 to be connected in parallel and conducted, the third illuminating set 1431 and the fourth illuminating set 1433 to be connected in parallel and conducted as well, and the first LED module 141 and the second LED module 143 to be connected in series, by controlling the first switching component S11, the second switching component S12, the third switching component S31, and the fourth switching component S32 to be conducted, and the fifth switching component S21 and the sixth switching component S22 not to be conducted.

In step S520, the control unit 15 may determine whether the inputted power supply is larger than two times of the loading voltage through the voltage detecting circuit in the detecting unit 11. If so, step S521 may be executed. Otherwise, step S505 may be returned.

In step S521, the control unit 15 may control the operations of the switching circuits so as to allow for the illuminating unit 14 to operate with two times of the loading voltage. For example, the control unit 15 may cause the first illuminating set 1411 and the second illuminating set 1413 to be connected in parallel and conducted, the third illuminating set 1431 and the fourth illuminating set 1433 to be connected in parallel and conducted as well, and the first LED module 141 and the second LED module 143 to be connected in series, by controlling the first switching component S11, the second switching component S12, the third switching component S31, and the fourth switching component S32 to be conducted, and the fifth switching component S21 and the sixth switching component S22 not to be conducted.

In step S532, the control unit may determine whether the first predetermined setting parameter may be utilized. If so, step S533 may be executed. Otherwise, step S540 may be executed.

In step S533, the control unit 15 may determine whether the inputted power supply is less than two times of the loading voltage through the voltage detecting circuit in the detecting unit 11. If so, step S534 may be executed. Otherwise, step S535 may be executed.

In step S534, the control unit 15 may control the operations of the switching circuits so as to allow for the illuminating unit 14 to operate with the loading voltage. For example, the control unit 15 may cause the first illuminating set 1411 and the second illuminating set 1413, the third illuminating set 1431, and the fourth illuminating set 1433 to be connected in parallel and conducted, by controlling the first switching component S11, the second switching component S12, the third switching component S31, and the fourth switching component S32, the fifth switching component S21, and the sixth switching component S22 to be conducted.

In step S535, the control unit 15 may control the voltage detecting circuit in the detecting unit 11 to determine whether the inputted power supply is less than three times of the loading voltage. If so, step S536 may be executed. Otherwise, step S537 may be executed.

In step S536, the control unit 15 may control the operations of the switching circuits so as to allow for the illuminating unit 14 to operate with two times of the loading voltage. For example, the control unit 15 may cause the first illuminating set 1411 and the second illuminating set 1413 to be connected in parallel and conducted, the third illuminating set 1431 and the fourth illuminating set 1433 to be connected in parallel and conducted, and the first LED module 141 and the second LED module 143 connected in series, by controlling the first switching component S11, the second switching component S12, the third switching component S31, and the fourth switching component S32 to be conducted, and the fifth switching component S21 and the sixth switching component S22 not to be conducted.

In step S537, the control unit 15 may control the voltage detecting circuit in the detecting unit 11 to determine whether the inputted power supply is less than four times of the loading voltage. If so, step S538 may be executed. Otherwise, step S505 may be returned.

In step S538, the control unit 15 may control the operations of the switching circuits so as to allow for the illuminating unit 14 to operate with three times of the loading voltage. For example, the control unit 15 may cause the first illuminating set 1411, the second illuminating set 1413, the third illuminating set 1431, and the fourth illuminating set 1433 to be connected in series and conducted by controlling the first switching component S11, the second switching component S12, the third switching component S31, the fourth switching component S32, the fifth switching component S21, and the sixth switching component S22 not to be conducted.

In step S540, the control unit 15 may control the voltage detecting circuit in the detecting unit 11 to determine whether the inputted power supply is less than two times of the loading voltage. If so, step S541 may be executed. Otherwise, step S505 may be returned.

In step S541, the control unit 15 may control the operations of the switching circuits so as to allow for the illuminating unit 14 to operate with the loading voltage. For example, the control unit 15 may cause the first illuminating set 1411 and the second illuminating set 1413, the third illuminating set 1431, and the fourth illuminating set 1433 to be connected in parallel and conducted, by controlling the first switching component S11, the second switching component S12, the third switching component S31, and the fourth switching component S32, the fifth switching component S21, and the sixth switching component S22 to be conducted.

When the first predetermined setting parameter is satisfied, steps S509-S514 and S533-S538 may be executed. On the other hand, when the second predetermined setting parameter is satisfied steps S520-S521 and steps S540-S541 may be executed.

Specifically speaking, both the first predetermined setting parameter and the second predetermined setting parameter may be satisfied when the inputted power supply is substantially the same as the predetermined threshold voltage defined in the first predetermined setting parameter and the second predetermined setting parameter. And the predetermined threshold voltage may correspond to whether the switching components in the switching circuits may be conducted, allowing for the control unit 15 to ensure the conducting voltage of the illuminating unit 14 may vary according to the variation in the inputted power supply.

The voltage detecting circuit of the detecting unit 11 may help detect whether the inputted power supply may correspond to the predetermined threshold voltage. Since the variation in the inputted power supply may be patterned, the inputted power supply may be reaching the predetermined threshold voltage at a specific point of the time. Therefore, to determine whether the inputted power supply reaches the predetermined threshold voltage counting a predetermined period of the time starting from the zero phase of the inputted power supply may serve as the basis on which the switching components in the switching circuits may be conducted.

The illuminating apparatus may thus utilize the inputted power supply of different values to dynamically adjust the conducting voltage of the illuminating unit for enhancing the illuminating efficiency of the illuminating unit and minimizing the occurrence of the flicks associated with the illuminating unit.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. An illuminating apparatus, comprising:

an illuminating unit comprising:

a first light emitting diode (LED) module having a first illuminating set, a second illuminating set, and a first switching circuit controlling a connection relationship between the first illuminating set and the second illuminating set;

a second LED module having a third illuminating set, a fourth illuminating set, and a third switching circuit controlling a connection relationship between the third illuminating set and the fourth illuminating set;

a second switching circuit for controlling a connection relationship between the first LED module and the second LED module;

a detecting unit for detecting an inputted power supply received by the illuminating unit; and a control unit coupled to the detecting unit, the first switching circuit, the second switching circuit, and the third switching circuit, for controlling the first switching circuit, the second switching circuit, and the third switching circuit based on the detected inputted power supply corresponding to a predetermined setting parameter so as to ensure a conducting voltage of the illuminating unit varies according to a variation in the inputted power supply.

2. An illuminating method using the illuminating apparatus recited in claim 1, wherein the illustrating apparatus includes the control unit, the detecting unit, and the illuminating unit with multiple illuminating sets at least including the first illuminating set, the second illuminating set, the third illuminating set, and the fourth illuminating set, and a switching unit at least including the first switching circuit, the second switching circuit, and the third switching circuit for adjusting a connection relationship among the illuminating sets, comprising:

preparing a setting parameter corresponding to an inputted power supply by the control unit; and detecting the inputted power supply so as to control the switching unit based on the setting parameter corresponding to the detected inputted power supply for ensuring a conducting voltage of the illuminating set to vary according to a variation in the inputted power supply.

3. The illuminating method according to claim 2, wherein the setting parameter indicates whether the switching unit is conducted with the inputted power supply and the control unit is configured to detect the inputted power supply before selecting the setting parameter.

4. The illuminating method according to claim 2, further comprising based on the detected inputted power supply adjusting a value of a current source providing the illuminating unit with a current with the value when the illuminating unit is conducted and adjusting the value of the current according to the conducting voltage of the illuminating unit.

5. The illuminating apparatus according to claim 1, wherein each of the first illuminating set, the second illuminating set, the third illuminating set, and the fourth illuminating set comprises multiple LEDs connected in series.

6. The illuminating apparatus according to claim 5, wherein the detecting unit further comprises a phase detecting circuit for detecting a phase of the inputted power supply on basis of which the control unit controls operations of the first switching circuit, the second switching circuit, and the third switching circuit according to the predetermined setting parameter corresponding to the detected phase of the inputted power supply.

7. The illuminating apparatus according to claim 5, wherein the control unit utilizes the predetermined setting parameter corresponding to a specification of the inputted power supply.

8. The illuminating apparatus according to claim 5, wherein the first switching circuit further comprises a first switching component coupled to the first illuminating set, a second switching component coupled to the second illuminating set, and a first unilaterally conducted component coupled between the first switching component and the second switching component;

wherein when the first switching component and the second switching component are conducted the first illuminating set and the second illuminating set are connected in parallel;

wherein when the first switching component and the second switching component are not conducted the first illuminating set and the second illuminating set are connected in series and the first unilaterally conducted component is conducted.

9. The illuminating apparatus according to claim 8, wherein the third switching circuit further comprises a third switching component coupled to the third illuminating set, a fourth switching component coupled to the fourth illuminating set, and a third unilaterally conducted component coupled between the third switching component and the fourth switching component, wherein when the third switching component and the fourth switching component are conducted the first illuminating set and the second illuminating set are connected in parallel, and wherein when the third switching component and the fourth switching component are not conducted the third illuminating set and the fourth illuminating set are connected in series and the third unilaterally conducted component is conducted.

10. The illuminating apparatus according to claim 9, wherein the second switching circuit further comprises a fifth switching component coupled to the first LED module, a sixth switching component coupled to the second LED module, and a second unilaterally conducted component coupled between the fifth switching component and the sixth switching component, wherein when the fifth switching component and the sixth switching component are conducted the first LED module and the second LED module are connected in parallel, and when the fifth switching component and the sixth switching component are not conducted the first LED module and the second LED module are connected in series with the second unilaterally conducted component conducted.

11. The illuminating apparatus according to claim 5 further comprises a current source coupled to the illuminating unit for providing a stable current with the illuminating unit when the illuminating unit is conducted, and a rectifying unit for rectifying an alternating current into the inputted power supply.

12. The illuminating apparatus according to claim 11, wherein the control unit controls the current source to supply the stable current of different values corresponding to the varied conducting voltage of the illuminating unit.

* * * * *